US005547547A

United States Patent [19]

Bengtsson

[11] Patent Number: 5,547,547

[45] Date of Patent: Aug. 20, 1996

[54] COMPACT FRAME ASSEMBLY FOR A PRESS IN A PAPERMAKING OR BOARDMAKING

[75] Inventor: Roland Bengtsson, Karlstad, Sweden

[73] Assignee: Valmet-Karlstad AB, Karlstad, Sweden

[21] Appl. No.: 346,470

[22] Filed: Nov. 29, 1994

[30] Foreign Application Priority Data

Dec. 2, 1993 [SE] Sweden ..... 9304051

[51] Int. Cl.[6] ..... D21F 3/00

[52] U.S. Cl. ..... 162/272; 162/358.1; 162/358.3

[58] Field of Search ..... 162/272, 273, 162/274, 358.1, 358.3, 360.2, 360.3; 100/108, 169, 176, 153

[56] References Cited

U.S. PATENT DOCUMENTS

| | | | |
|---|---|---|---|
| 2,157,455 | 5/1939 | Kimmel . | |
| 3,171,305 | 3/1965 | Stone . | |
| 3,921,514 | 11/1975 | Biondetti . | |
| 3,946,587 | 3/1976 | Maltby . | |
| 4,022,122 | 5/1977 | Moser et al. . | |
| 4,116,028 | 9/1978 | Okamoto et al. . | |
| 4,154,080 | 5/1979 | Suzuki et al. . | |
| 4,164,858 | 8/1979 | Holmes . | |
| 4,206,700 | 6/1980 | Stotz et al. . | |
| 4,272,317 | 6/1981 | Roerig . | |
| 4,356,764 | 11/1982 | Haugen . | |
| 4,423,612 | 1/1984 | Uppaluri . | |
| 4,567,933 | 2/1986 | Lauener et al. . | |
| 4,715,206 | 12/1987 | Forni . | |
| 4,790,908 | 12/1988 | Roerig et al. . | |
| 4,817,407 | 4/1989 | Alich . | |
| 4,877,487 | 10/1989 | Miller . | |
| 4,920,778 | 5/1990 | Svagr et al. . | |
| 5,195,345 | 3/1993 | Porombka et al. . | |
| 5,207,872 | 5/1993 | Jansson . | |
| 5,250,154 | 10/1993 | Didier . | |
| 5,291,770 | 3/1994 | Koujin et al. . | |
| 5,291,826 | 3/1994 | Schiel . | |
| 5,305,689 | 4/1994 | Schiel | 100/169 |
| 5,385,088 | 1/1995 | Grabscheid | 100/168 |
| 5,399,242 | 3/1995 | Schiel . | |
| 5,400,708 | 3/1995 | Meschenmaser | 100/168 |
| 5,404,811 | 4/1995 | Schiel et al. . | |
| 5,413,036 | 5/1995 | Schiel . | |

FOREIGN PATENT DOCUMENTS

| | | |
|---|---|---|
| 0326844B1 | 6/1993 | European Pat. Off. . |
| 533462 | 8/1993 | European Pat. Off. . |
| 1936769 | 2/1971 | Germany . |
| 8232424 | 10/1985 | Germany . |
| 935363 | 8/1963 | United Kingdom . |
| 2024682A | 1/1980 | United Kingdom . |
| WO92/17641 | 10/1992 | WIPO . |
| WO93/12290 | 6/1993 | WIPO . |

*Primary Examiner*—David L. Lacey
*Assistant Examiner*—Calvin Padgett
*Attorney, Agent, or Firm*—Bell, Seltzer, Park, & Gibson, P.A.

[57] ABSTRACT

In a compact frame assembly for a press having a top roll (5) and a bottom roll (4), the ends of which are supported in bearing housing members, each bearing housing member (16) for the bottom roll (4) has a head portion (53) of substantially T-shaped cross section, and each bearing housing member (17) for the top roll (5) has a foot portion (54) of inverted substantially T-shaped cross section. The foot portion stands on the head portion, and two sturdy channel bars (34, 35) are pivotally mounted laterally of the head portion and the foot portion, one on each side. The channel bars may be swung into clamping engagement with the cross bars (55) of the two tees to connect the head portion (53) to the foot portion (54). One of the rolls may be a shoe type press roll (4) having a flexible roll shell (11), and preferably the bearing housing members (16) of that roll have the basic shape of circular disks of a diameter that is smaller than the diameter of the flexible shell (11) to facilitate an exchange of the flexible shell.

8 Claims, 11 Drawing Sheets

17
48
5
60
58
59
61
63
69
64
34
57
65
54
67
35
68
53
77
11
4
79
80
47
78
16

COMPACT FRAME ASSEMBLY FOR A PRESS IN A PAPERMAKING OR BOARDMAKING

FIELD AND BACKGROUND OF THE INVENTION

The present invention relates to an improved compact frame assembly for a press.

More particularly, the invention relates to an improved compact frame assembly for a press having two parallel opposed rolls for subjecting a moving web to pressure in a nip formed between the rolls, both of which have two ends. At least one of the rolls has a stationary support beam, a rotatable roll shell disposed about the beam and defining a space therebetween, and a roll shell support carried by the beam in the space for providing vertically-movable and rotatable support of the roll shell relative to the support beam. The compact frame assembly includes four bearing housing members adapted to be mounted one on each roll end for supporting the roll end at least pivotally. Each of the two bearing housing members for one of the rolls is adapted to be disposed at an adjacent one of the two bearing housing members for the other roll and form with said adjacent bearing housing member a pair of bearing housing members. The compact frame assembly further includes a device for interconnecting the two bearing housing members of each pair. The interconnecting device includes for each pair of bearing housing members at least two interconnecting members, and each member has a web portion and two rim portions projecting from the web portion. The bearing housing members have surfaces defining recesses for engagement with said rim portions so as to prevent the two bearing housing members of each pair from appreciably moving away from each other on loading of the press.

Although prestressed press framework of the type disclosed in U.S. Pat. No. 5,207,872 (Jansson) for a papermaking or boardmaking machine has proved to be excellent in most respects, in certain cases—such as when rebuilding the press sections of certain papermaking or boardmaking machines by substituting a shoe type press and associated framing for an existing high impact roll press and associated framing, for example—it will require a larger space than the one available. To overcome this disadvantage, a few compact frame designs have been developed, cf. U.S. Pat. Nos. 5,291,826 (Schiel) (=International Patent Publication No. WO 92/17641 (J. M. Voith)) and 5,305,689 (Schiel), International Patent Publication No. WO 93/12290 (J. M. Voith), and European Patent Publication No. EP-A- 0 553 462 (Sulzer-Escher Wyss), for example. These compact frame designs permit an easy substitution of a new felt for a worn one, the two first ones also permit an easy substitution of a new flexible roll shell for a worn one, and they form a platform on which the present invention is based.

In the compact frame designs disclosed in the WO 92/17641 and WO 93/12290, at their ends the two rolls are supported in bearing housing members. The bearing housing members of one roll are connected to those of the other roll by means of substantially I-shaped tie rods having hammer head ends. The tie rods are designed to be of relatively low flexural rigidity, and they are inserted from positions lateral of the rolls into recesses provided in the bearing housing members at locations closer to the load plane of the press. When the press is unloaded, each bearing housing member of one roll may be spaced a variable distance from the adjacent bearing housing member of the other roll or, alternatively, may support the adjacent bearing housing member indirectly over an intermediary member, which is removable in order to simplify an exchange of a press fabric extending through the press nip formed between the rolls. However, in an unloaded press the tie rods are not prestressed at all or just very little, so that also in the latter case a loading of the press will stretch the tie rods elastically and cause the forming of a gap between the intermediary member and the bearing housing member that in an unloaded press is supported thereby. The tie rods may be 0.7 to 1.5 meters in length, and the elastic stretching of them results in a larger required stroke of the press shoe in order to bridge the formed gap and achieve the desired pressing effect in the extended nip. The disclosed design permits axial displacement of a bearing housing member in relation to the intermediary member and the other bearing housing member of a pair to compensate for changes in length caused by thermal expansion or contraction of the stationary support beam or the rotatable roll shell, for example. On the other hand, a long stroke of the press shoe is disadvantageous. For example, when the press shoe is included in a shoe type press roll having a flexible roll shell for forming an extended press nip, a long stroke will expose the flexible roll shell to larger stresses and, consequently, contribute to a reduction of the life of the flexible roll shell.

When the two bearing housing members of a pair are not rigidly pressed against each other, there is some risk of one of them becoming dislocated to a position at the side of the load plane of the press. A dislocation will cause the nip pressure profile to vary in the cross machine direction. To solve this problem, the WO 93/12290 proposes the use of guide surfaces that extend parallel to the load plane and maintain the two bearing housing members of a pair in proper alignment also when they move away from each other.

Also in the compact frame design disclosed in the EP-A-0 553 462 the bearing housing members of one roll are connected to those of the other roll by means of substantially I-shaped tie rods that are parallel to the load plane of the press. However, in this case the tie rod ends are enlarged to a semicircular shape, the straight boundary line of which forms the end face of the tie rod. As before, the bearing housing members are provided with recesses for engagement with the tie rods, but the tie rods are inserted into the recesses from positions axially outside of the bearing housing members. A removable intermediary member of a rectangular cross section may be partly embedded in each of the two bearing housing members of a pair in order to absorb any occurring shear forces. This design is unstable in the machine direction and requires that the bearing housing members of at least one of the rolls are supported in the machine direction by roll standards or the like. Although it is stated in the EP-A- 0 553 462 that by removing the intermediary member and the tie rods an exchange of the flexible roll shell can be carried out without any problems, the drawing clearly shows that it is impossible to exchange the flexible roll shell without first removing one of the bearing housing members from the stationary support beam, because they are too large to pass through the interior of the flexible roll shell.

SUMMARY OF THE INVENTION

An object of the present invention is to provide an improved compact frame assembly for a press in a papermaking or boardmaking machine, which assembly permits an easy exchange of a felt and/or a flexible roll shell, and in which the distance roll axis to roll axis in the press is maintained substantially constant on loading of the press.

In accordance with the present invention this object is achieved by incorporating the following features in the compact frame assembly described in the introduction above.

The interconnecting members are in the shape of sturdy channel bars, and the web portion and the two rim portions of the interconnecting members constitute a channel bottom and two channel sides, respectively, in each channel bar. Each channel formed by each channel bar has a symmetrical cross sectional shape that over a major portion of a channel depth is of constant channel width from channel side to channel side. Further, each bearing housing member in each pair includes a plate member having two sides which, when the bearing housing member is mounted on a roll end, extend in a plane substantially parallel to a plane perpendicular to an axis of rotation of the rotatable roll shell, with one side facing the rolls and the other side facing in an opposite direction. The recesses for engagement with the interconnecting members are elongated and substantially L-shaped in cross section and located one in each side of the plate member at an edge thereof. Additionally, the recesses extend parallel to each other and to the above-mentioned edge, so as to form in one of the two plate members a head portion of substantially T-shaped cross section and in the other a foot portion of inverted substantially T-shaped cross section. At their top, the head portion and foot portion each have a cross piece with a central portion, two free ends, and a plane top face. The two plate members in each pair of bearing housing members are disposed with the cross piece top face of the head portion facing the cross piece top face of the foot portion. The cross piece of the head portion, the cross piece of the foot portion and, if desired, a removable intermediary member, which spaces the foot portion from the head portion, are of a combined thickness that is slightly smaller than the channel width of the channel bars. Still further, a device is provided for mounting two channel bars with their channels facing each other, one on each side of the pair of plate members, and with the channel bars in clamping engagement with the cross pieces of the head portion and the foot portion.

Since the improved compact frame assembly of the present invention does not require the provision of a removable intermediary member between the two bearing housing members of one pair in order to permit an easy exchange of felt or flexible roll shell, it is suitable that the head portion directly supports the foot portion, at least when the press is in an unloaded condition.

Means suitably are provided for preventing the plate members from being displaced relative to each other in a plane perpendicular to a loading direction of the press. Such displacement preventing means may be located between the two plate members of each pair and may include keys disposed in two pairs of crossing opposed key-ways provided in the two plate members of each plate member pair.

In order to avoid that the weights of the channel bars will be a bother to the mechanics, the device for mounting the channel bars preferably includes a device for moving the channel bars between a first position, where they are in engagement with the head portion and foot portion of substantially T-shaped cross section of each of the plate members in a pair of housing members, and a second position, where the channel bars are more spaced from each other and out of engagement with the portions, so as to permit one of the portions to be moved away from the other. The moving device may include a link system, in which the channel bars are suspended, and at least one actuator for swinging the links of the system and, thus, the channel bars away from and back toward one another.

To achieve an inexpensive and reliable position locking of the channel bars, the device for mounting the channel bars preferably includes at least one nut member that is secured to an axial end of one of the two channel bars, a screw guide member secured to an adjacent axial end of the other channel bar, and a machine screw. The nut member has a threaded bore extending in a direction substantially perpendicular to the web portion of said one of the channel bars, and the screw guide member has a bore extending in a direction substantially perpendicular to the web portion of said other channel bar and in alignment with the threaded bore when the two channel bars are in engagement with the cross pieces of the head portion and the foot portion. The machine screw extends through the bore of the screw guide member and into threaded engagement with the threaded bore of the nut member.

To facilitate the exchange of a press felt or a flexible roll shell, it is suitable to provide means for temporarily spacing one of the rolls from the other roll, after first disconnecting the channel bars from the bearing housing members, so as to form between the two rolls a temporary gap permitting the exchange of the press fabric or the flexible roll shell.

Preferably, when one of the two rolls is a shoe type press roll having a stationary support beam and a rotatable, flexible roll shell of a predetermined diameter, a maximum dimension of the bearing housing members for the shoe type press roll is smaller than said predetermined diameter so as to permit a worn flexible shell to be pulled out axially from the support beam and exteriorly of the bearing housing member, and a new flexible shell to be substituted for the worn one by pulling the new shell exteriorly over the bearing housing member and onto the support beam. In order to facilitate this exchange, the channel bars are disconnected from the bearing housing members and one of the rolls is temporarily lifted from the other roll. Additionally, one end of the shoe type press roll is lifted from a frame member normally supporting the bearing housing member, so as to form a temporary gap between the bearing housing member of the lifted end of the shoe type press roll and the frame member.

The present invention will below be described more in detail with reference to the appended drawings, which illustrate preferred embodiments of the invention.

DETAILED DESCRIPTION OF THE ILLUSTRATED EMBODIMENTS

Figure 1:
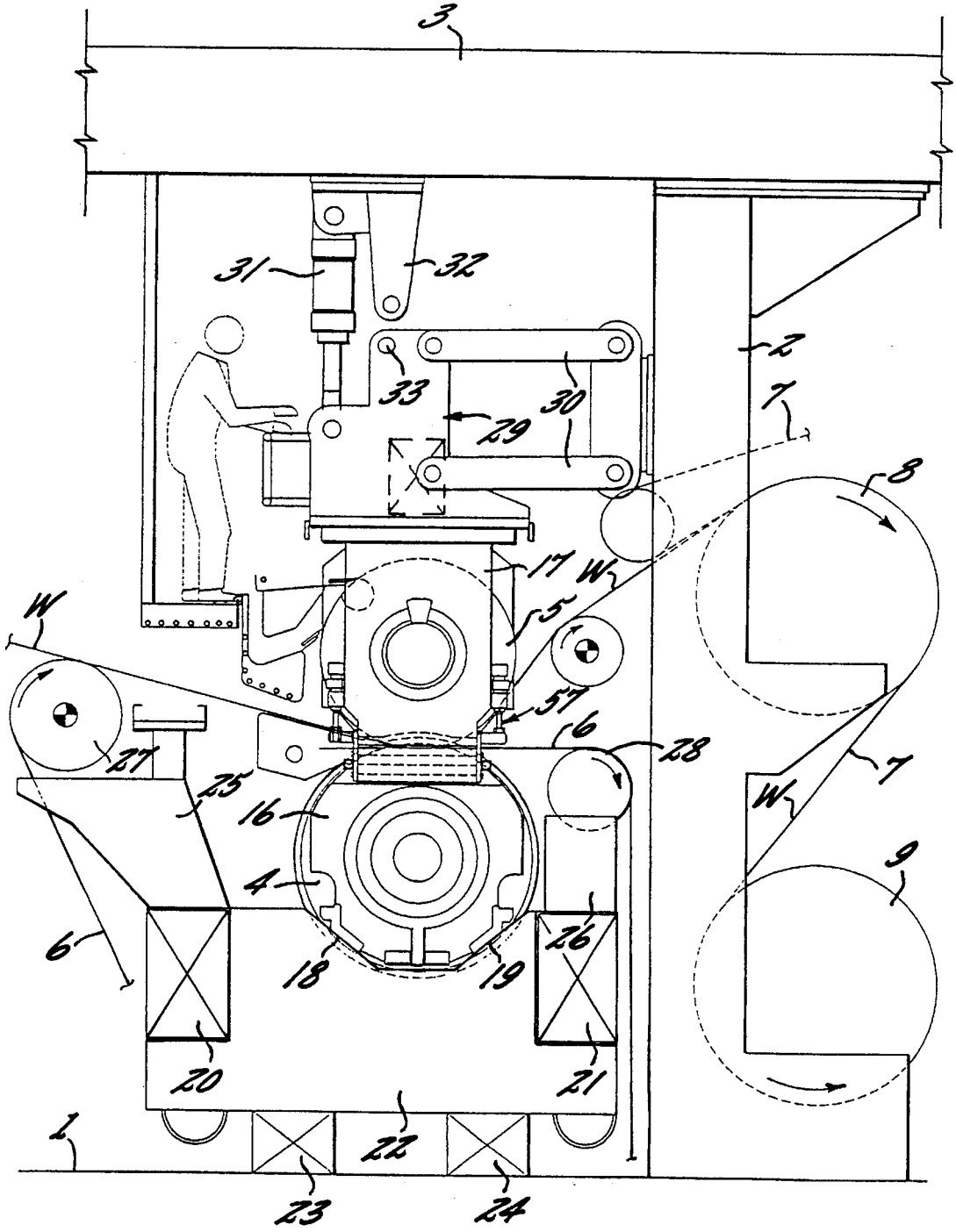
FIG. 1 is a schematic side elevational view of a part of a press section of a papermaking or boardmaking machine including a press having an improved compact frame assembly in accordance with the present invention.

FIG. 1 shows a downstream portion of a press section of a papermaking or boardmaking machine, and an upstream portion of a drying section connecting on to the press section. The machine has a frame including two longitudinally extending parallel bottom rails, one of which is shown in FIG. 1 and designated 1. A plurality of vertical columns, one of which is shown in FIG. 1 and designated 2, are supported by the bottom rails and extend upward therefrom. At their tops, the columns support longitudinally extending top beams, one of which is shown in FIG. 1 and designated 3, parallel to each other and to the bottom rails. Where necessary, the top beams, the columns and the bottom rails are interconnected by means of laterally extending cross beams, not shown.

The illustrated portion of the press section includes a press having two parallel opposing rolls 4 and 5 for subjecting a moving paper or board web W to pressure in a nip formed between the rolls 4 and 5. The shown press has roll 5 located on top of roll 4 to form a vertical press plane, and the press is a single-felted press having an endless press felt 6 running through the press nip for transporting the moving web W through the nip. Even though not illustrated, the press could be a double-felted press where the web is sandwiched between two press felts while passing through the nip, or, alternatively, it could be a calender where no felt or other fabric is used for passing the web through the nip. A calender is located downstream of the drying section or separate from the paper or board machine and is used for subjecting the paper or board web to a mechanical treatment in a roll nip to change the shape or the surface of the web.

In the embodiment illustrated in FIG. 1, after pressing in the nip the web W is detached from the press felt and run to a drying fabric 7, which conveys the web around a plurality of drying cylinders, two of which are designated 8 and 9, and onwards through at least a first portion of the drying section.

Figure 2:
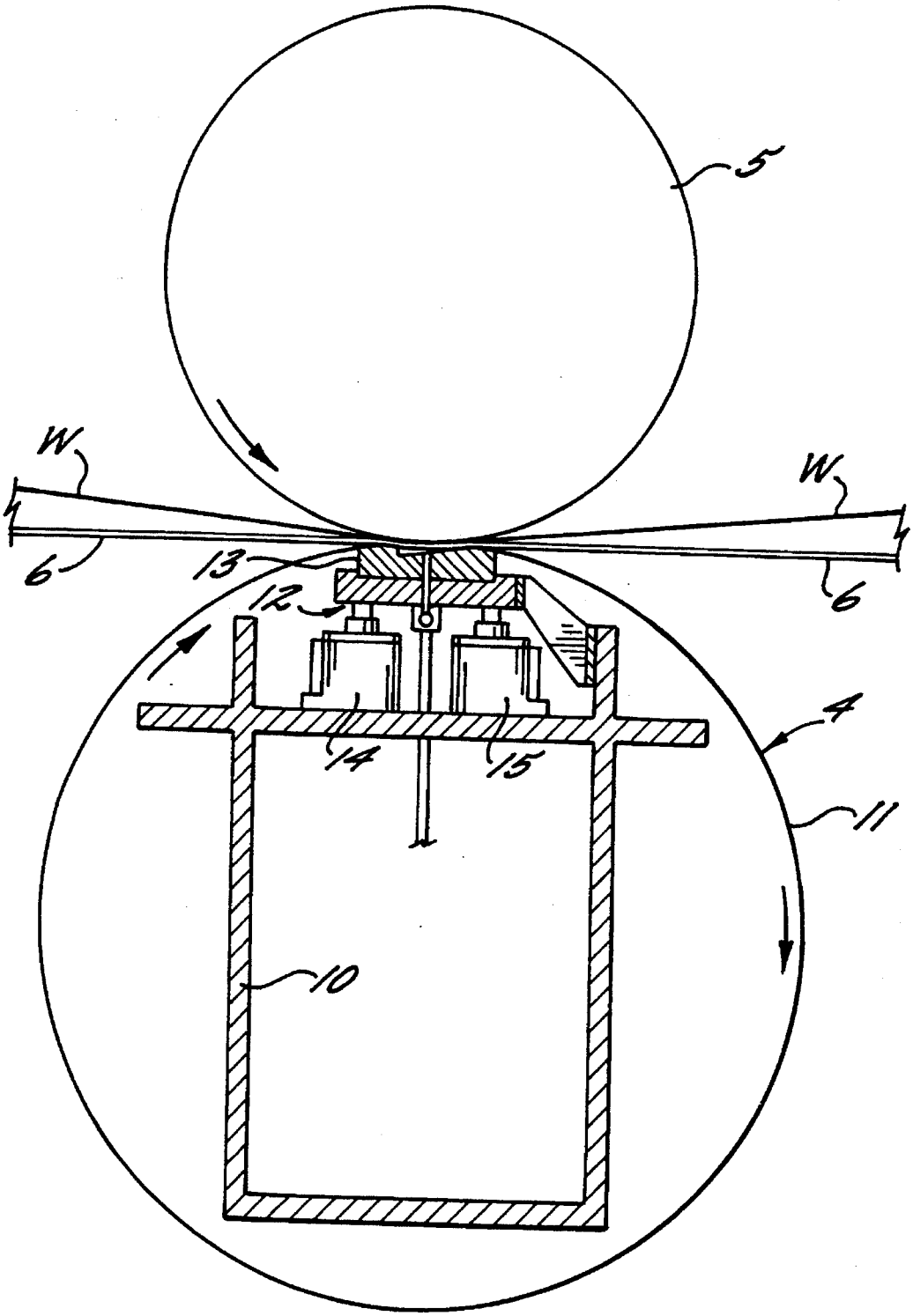
FIG. 2 is a schematic cross sectional view of the press, which is a single-felted extended nip press and has a shoe type press roll and a counter roll.

At least one of the two rolls, more specifically—in the embodiment shown in FIG. 2—roll 4, has a stationary support beam 10, a rotatable roll shell 11 disposed about the beam and defining a space therebetween, and a roll shell support device, generally designated 12, for providing vertically-movable and rotatable support of the roll shell 11 relative to the support beam 10. In the preferred embodiment shown the roll shell 11 is flexible, and the roll shell support includes a hydrostatic press shoe 13 and two rows of hydraulic jacks 14 and 15 for adjustably pressing a leading edge and a trailing edge of the shoe 13 against the interior surface of the flexible shell 11. The shoe face pressed against the flexible shell has a concavely recessed surface portion adapted to the peripheral shape of the other roll 5 so as to form an extended nip between the flexible shell 11 and said other roll 5.

With reference to FIG. 1, a compact frame assembly is used to maintain rolls 4 and 5 in their intended positions. The compact frame assembly includes two bearing housing members 16 for roll 4 and two bearing housing members 17 for roll 5. These four bearing housing members are adapted to be mounted one on each roll end for supporting the roll ends at least pivotally. Further, each of the two bearing housing members for one of the rolls is adapted to be disposed adjacent to each of the two bearing housing members for the other roll and forms with said adjacent bearing housing member a pair of bearing housing members.

Each bearing housing member 16 for bottom roll 4 has two seat surfaces 18 and 19 placed symmetrically with respect to the vertical press plane and facing downwards-outward therefrom. Two cantilever beams 20 and 21 extend parallel to each other across the width of the machine and are interconnected by two cross beams 22 extending in the machine direction. Each cross beam has a vertical recess shaped to conform with a bottom portion of bearing housing member 16 and its two seat surfaces 18 and 19. Each bearing housing member 16 is secured to its associated cross beam 22 by means of screws, not shown. Two removable supports 23 and 24 are shown inserted between a bottom surface of one of the cross beams 22 and the adjacent one of the bottom rails 1 with these two supports 23 and 24 being temporarily removed when a new press felt 6 has to be substituted for a worn one. Cantilever beams 20 and 21 are shown having brackets 25 and 26, respectively, for a driven guide roll 27 and a non-driven one 28, respectively, for the press felt 6.

Figure 3:
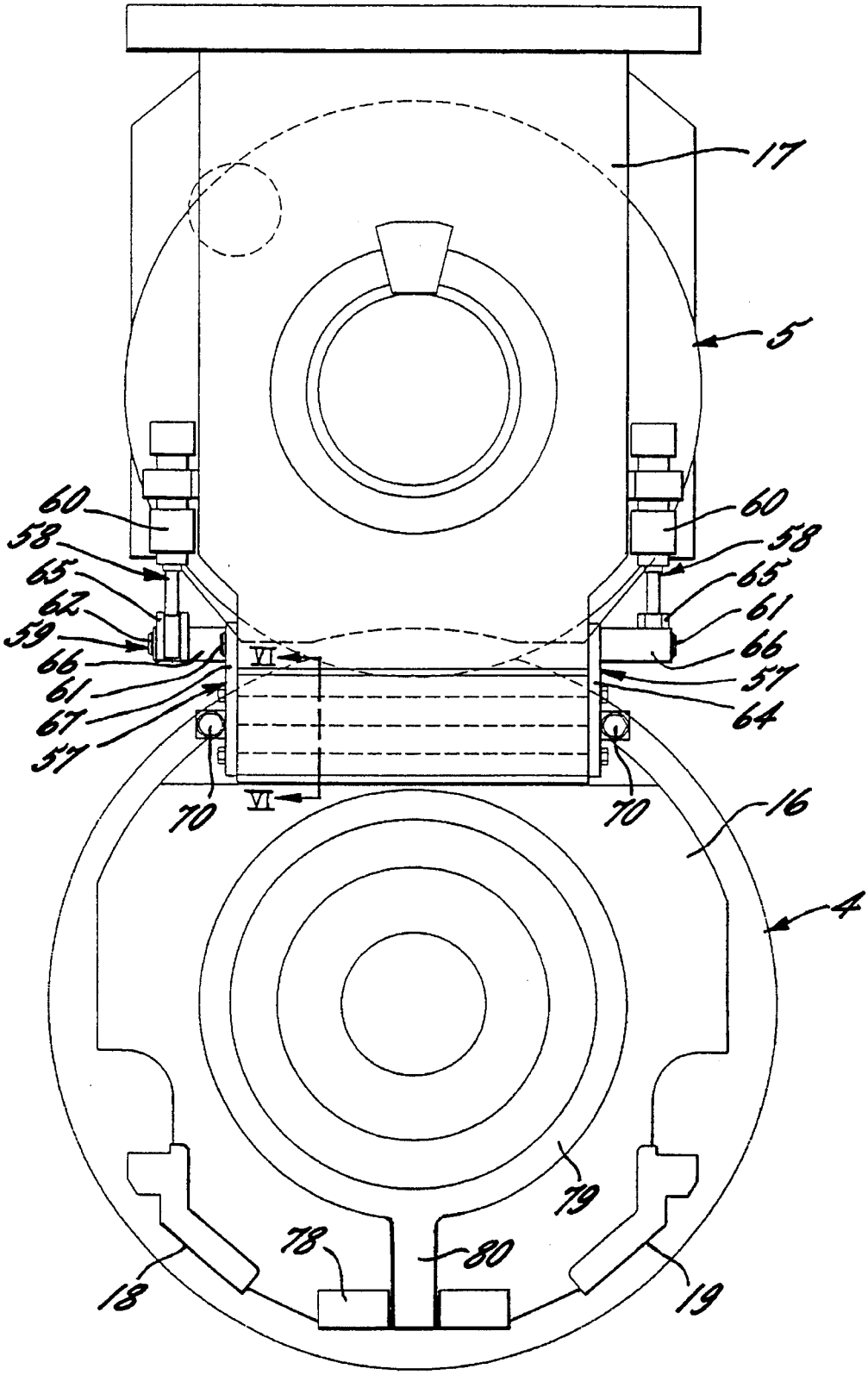
FIG. 3 is an enlarged scale side elevational view of the improved compact frame assembly shown in FIG. 1, including two bearing housing members, members for interconnecting the bearing housing members, the two rolls carried by the assembly, and a device in accordance with one embodiment of the invention for moving the interconnecting members into and out of engagement with the bearing housing members.
Figure 4:
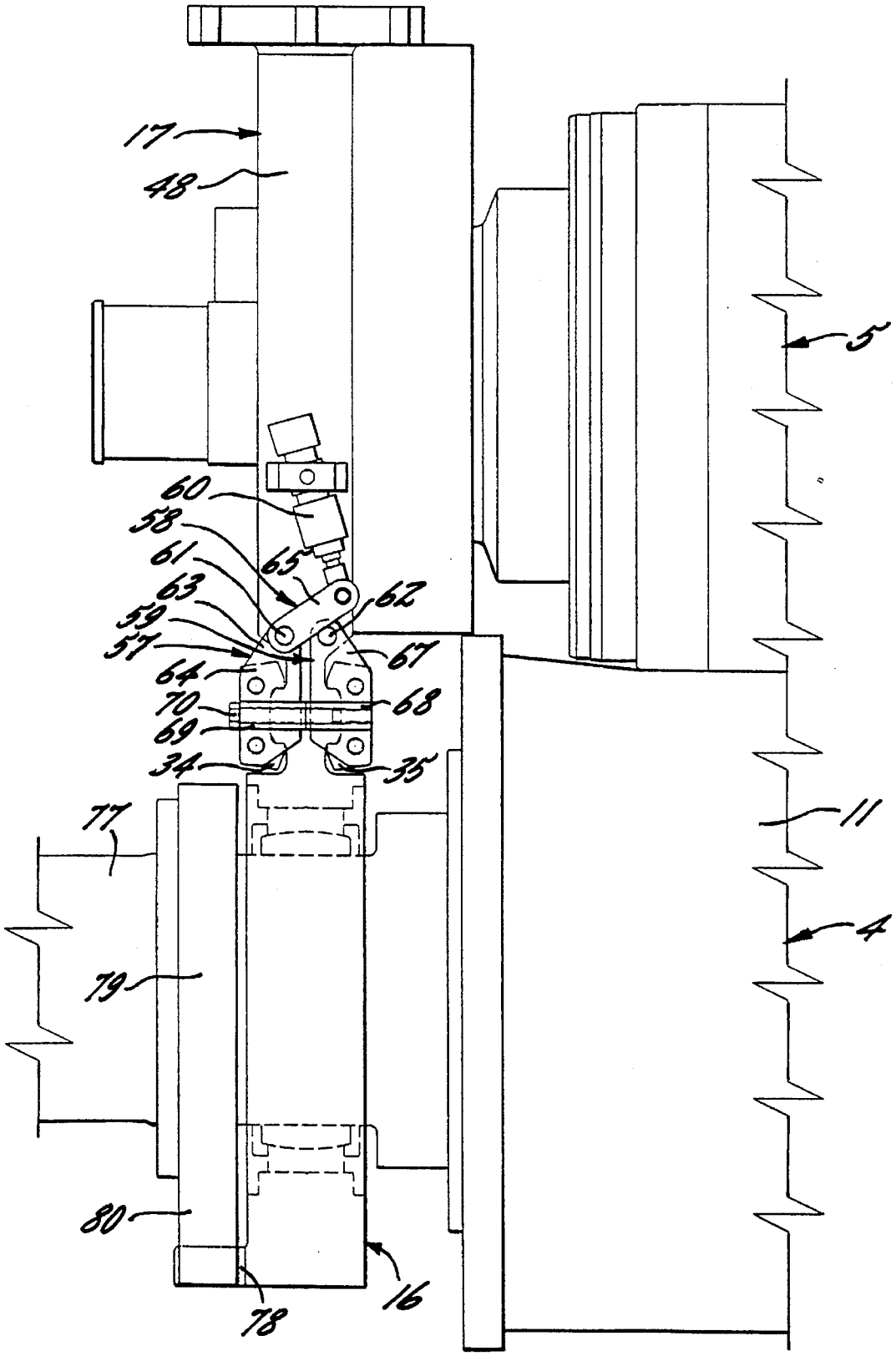
FIG. 4 is a longitudinal elevational view of the improved compact frame assembly shown in FIG. 3 and the ends of the two rolls carried by the assembly.

As shown in FIG. 3, at its axial ends, stationary support beam 10 is provided with stub shafts 77, above referred to as roll ends of bottom roll 4, and each stub shaft 77 extends through its associated bearing housing member 16. To prevent any rotation of the stationary support beam 10, a forked stop member 78 is mounted on bearing housing member 16 with the furcations of the forked stop member 78 extending parallel to the axis of bottom roll 4 and being equidistantly spaced from said roll axis, and a ring member 79 is fixedly clamped onto stub shaft 77 and has an arm 80 projecting radially into the gap formed between the furcations with a minimum of play between arm 80 and the furcations of stop member 78. Forked stop member 78, ring member 79, and arm 80 are best shown in FIGS. 3 and 4.

Referring to FIG. 1, on the drive side of the machine, a gear box is integral with bearing housing member 17, and a dashed circle in an upper descending quadrant of roll 5 indicates how rotational power is supplied to roll 5. At its top, each bearing housing member 17 for top roll 5 is fixed by means of screws, not shown, to a suspended vertically movable beam 29 extending parallel to top roll 5. Each end of beam 29 is shown pivotally connected to adjacent column 2 over a parallel link mechanism 30, which restricts the movement of the beam 29, when lifted or lowered, to a substantially vertical movement. Lifting and lowering is necessary when a new press felt 6, for example, has to be substituted for a worn one, or when roll 5 has to be temporarily spaced from roll 4 for some other reason. For lifting beam 29 and, thus, roll 5 so as to space roll 5 from roll 4, a lift cylinder 31 is pivotally interconnected between each end of the beam and the adjacent top beam 3. A lug 32 projects downwards from each top beam 3, and beam 29 has two end walls, each of which has a bore 33 that upon lifting of beam 29 will be placed in alignment with a corresponding hole in the lug 32, so as to permit the insertion of a bolt, not shown, through each lug and associated bore in order to temporarily lock beam 29 in its lifted position.

To form a complete and operative compact frame assembly, the assembly includes—in addition to the four bearing housing members 16 and 17—a device for interconnecting the two bearing housing members of each pair. As is most clearly shown in FIGS. 6 and 7, this interconnecting device includes, for each pair of bearing housing members, at least two interconnecting members 34 and 35. Each of the interconnecting members has a web portion 36, and two rim portions 37 and 38 projecting from the web portion. Further, the bearing housing members 16 and 17 have surfaces defining recesses 39, 40, 41, and 42, respectively, for engagement with the rim portions 37 and 38 of each of the interconnecting members 34 and 35 so as to prevent the two bearing housing members 16 and 17 of each pair from appreciably moving away from each other on loading of the press.

In accordance with the present invention the interconnecting members 34 and 35 are in the shape of sturdy channel bars, and the web portion 36 and the two rim portions 37 and 38 of the interconnecting members constitute a channel bottom 43 and two channel sides 44 and 45, respectively, in each channel bar 34 and 35. Each channel 46 has a symmetrical cross sectional shape, which over a major portion of a channel depth is of constant channel width from channel side 44 to channel side 45. The thickness of the web portion 36 of the channel bar and those of the two rim portions 37 and 38 are more than twice the depth of channel 46. Further, each bearing housing member 16 or 17 in each pair includes a plate member 47 and 48, respectively. The basic shape of plate member 47 is a circular disk while that of plate member 48 is a rectangular parallelepiped, and each plate member 47 and 48 has two sides 49, 50, 51, 52, respectively. When the bearing housing member 16 or 17 is mounted on a roll end, each of these sides forms a plane that is substantially parallel to a plane perpendicular to an axis of rotation of the rotatable roll shell 11, with one side (50 and 52) of each plate member (47 and 48, respectively) facing the rolls and the other side (49 and 51) facing in an opposite direction.

The recesses 39, 40, 41 and 42 for engagement with the interconnecting members 34 and 35 are elongated and of substantially L-shaped cross section and located one in each side of the plate member 47 and 48, respectively, at an edge thereof, and they extend parallel to each other and to said edge, so as to form in one of the two plate members 47 and 48 a head portion 53 of substantially T-shaped cross section, and in the other one of the two plate members 47 and 48 a foot portion 54 of inverted substantially T-shaped cross section. In both cases, the "T" shaped head portion and foot portion each have a cross piece 55 with a central portion, two free ends, and a plane top face 56. The two free ends are of constant thickness, disregarding a bevelled outer edge of the bottom face of the cross piece. The two plate members 47 and 48 in each pair of bearing housing members 16 and 17 are disposed with the cross piece top face 56 of the head portion 53 facing that of the foot portion 54. The cross piece 55 of the head portion 53 and the cross piece 55 of the foot portion 54 and, if desired, a removable intermediary member, not shown, which may be provided to space the foot portion 54 from the head portion 53, are of a combined thickness that is slightly smaller than the channel width of the channel bars 34 and 35. Still further, a device 57 is provided for mounting two channel bars 34 and 35 with their channels 46 facing each other, one on each side of the pair of plate members 47 and 48, and with the channel bars 34 and 35 in clamping engagement with the cross pieces 55 of the head portion 53 and the foot portion 54.

Figure 6:
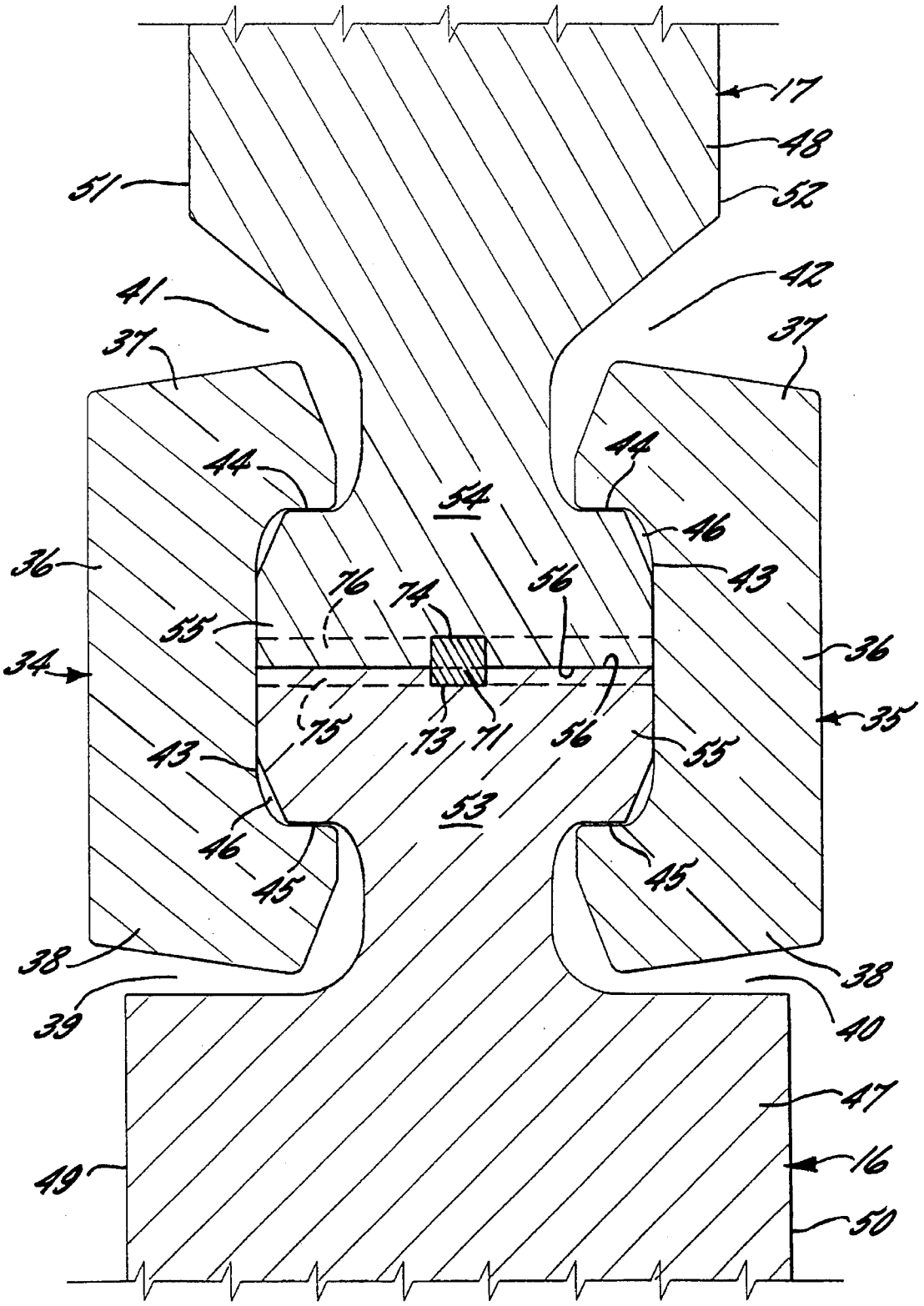
FIG. 6 is an enlarged scale cross sectional view taken upon line VI—VI of FIG. 3 with the press unloaded and shows a head portion of substantially T-shaped cross section on one bearing housing member and a foot portion of inverted substantially T-shaped cross section on the other bearing housing member interconnected by means of interconnecting members, the foot portion standing on the head portion.
Figure 7:
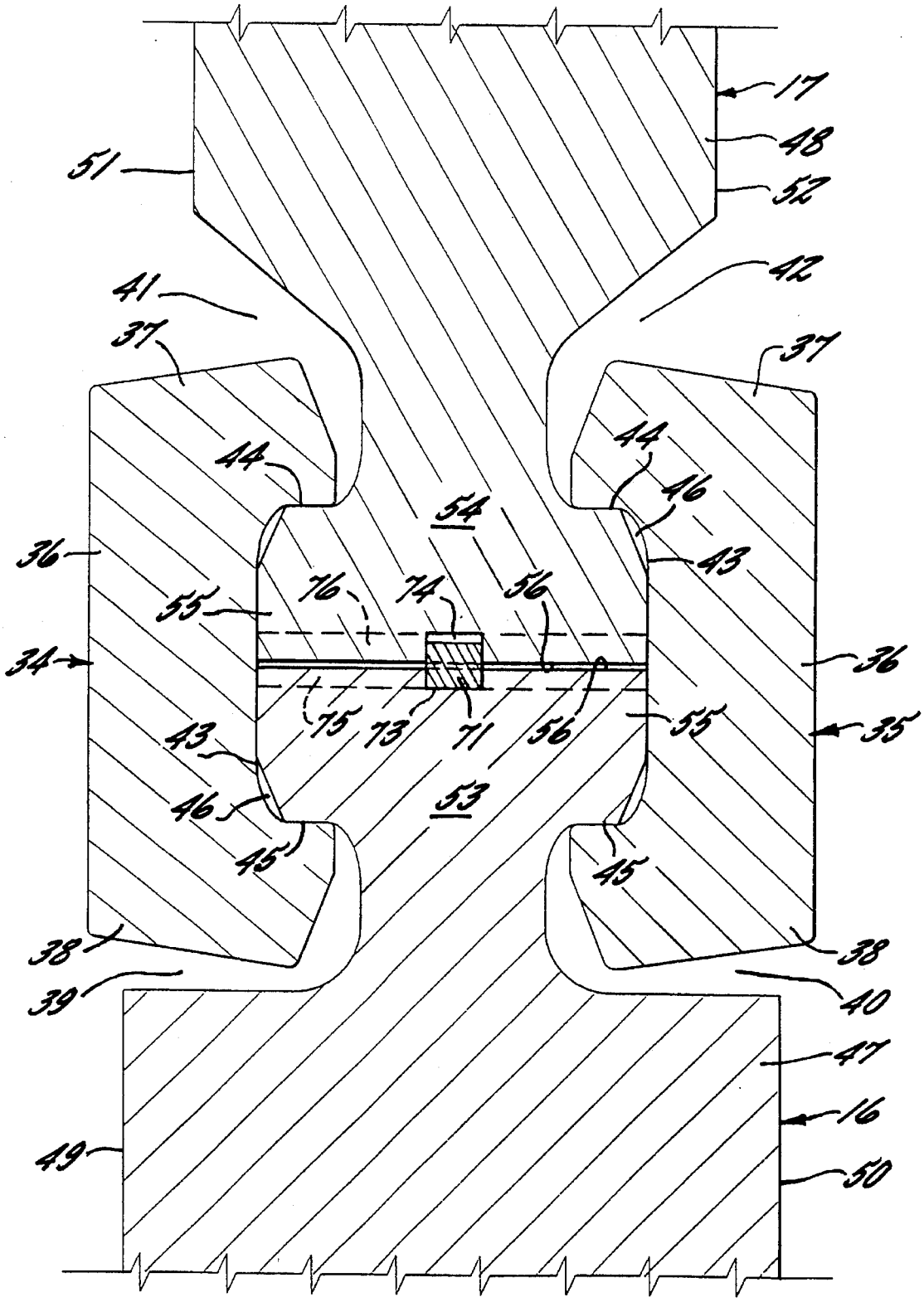
FIG. 7 is an enlarged scale cross sectional view similar to FIG. 6 but with the press loaded and a gap spacing the foot portion from the head portion.
Figure 8:
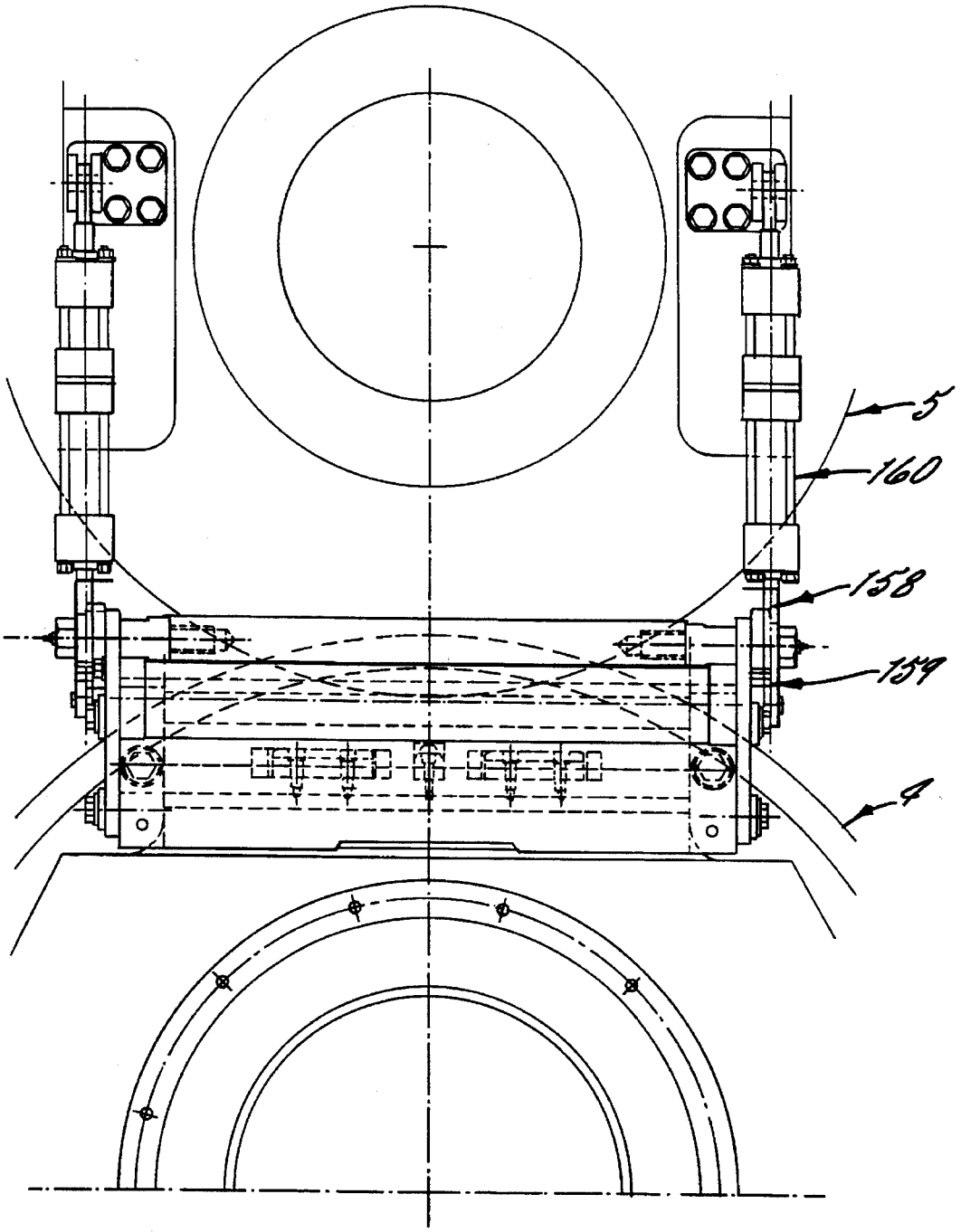
FIG. 8 is a side elevational view similar to FIG. 3, showing the compact frame assembly including two bearing housing members, members for interconnecting the bearing housing members, and a device in accordance with another embodiment of the invention for moving the interconnecting members into and out of engagement with the bearing housing members.

Since the improved compact frame assembly of the present invention does not require the provision of a removable intermediary member between the two bearing housing members 16 and 17 of one pair in order to permit an easy exchange of felt 6 or flexible roll shell 11, it is preferred that the head portion 53 directly supports the foot portion 54, at least when the press is in an unloaded condition, as illustrated in FIG. 6. On loading of the press, head portion 53 and foot portion 54 will be pulled away from each other a small distance, corresponding to the total clearance required for easy mounting, until the movement is stopped by the bottom faces of the cross pieces 55 engaging the channel sides 44 and 45 of the sturdy channel bars. Then, a small gap is formed between the plane top faces 56 of cross pieces 55 as shown in FIG. 7.

Means indicated by numerals 71, 73, 74, 75, and 76 suitably are provided for preventing the plate members 47 and 48 of each plate member pair from being displaced relative to each other in a plane perpendicular to a loading direction of the press. Such displacement preventing means may be located between the two plate members 47 and 48 of each pair as shown in FIGS. 6 and 7 and may include keys disposed in two pairs of crossing opposed key-ways 73, 74, and 75, 76, respectively, provided in the two plate members 47 and 48 of each plate member pair. One key, designated 71, is shown in FIGS. 6 and 7.

Figure 5:
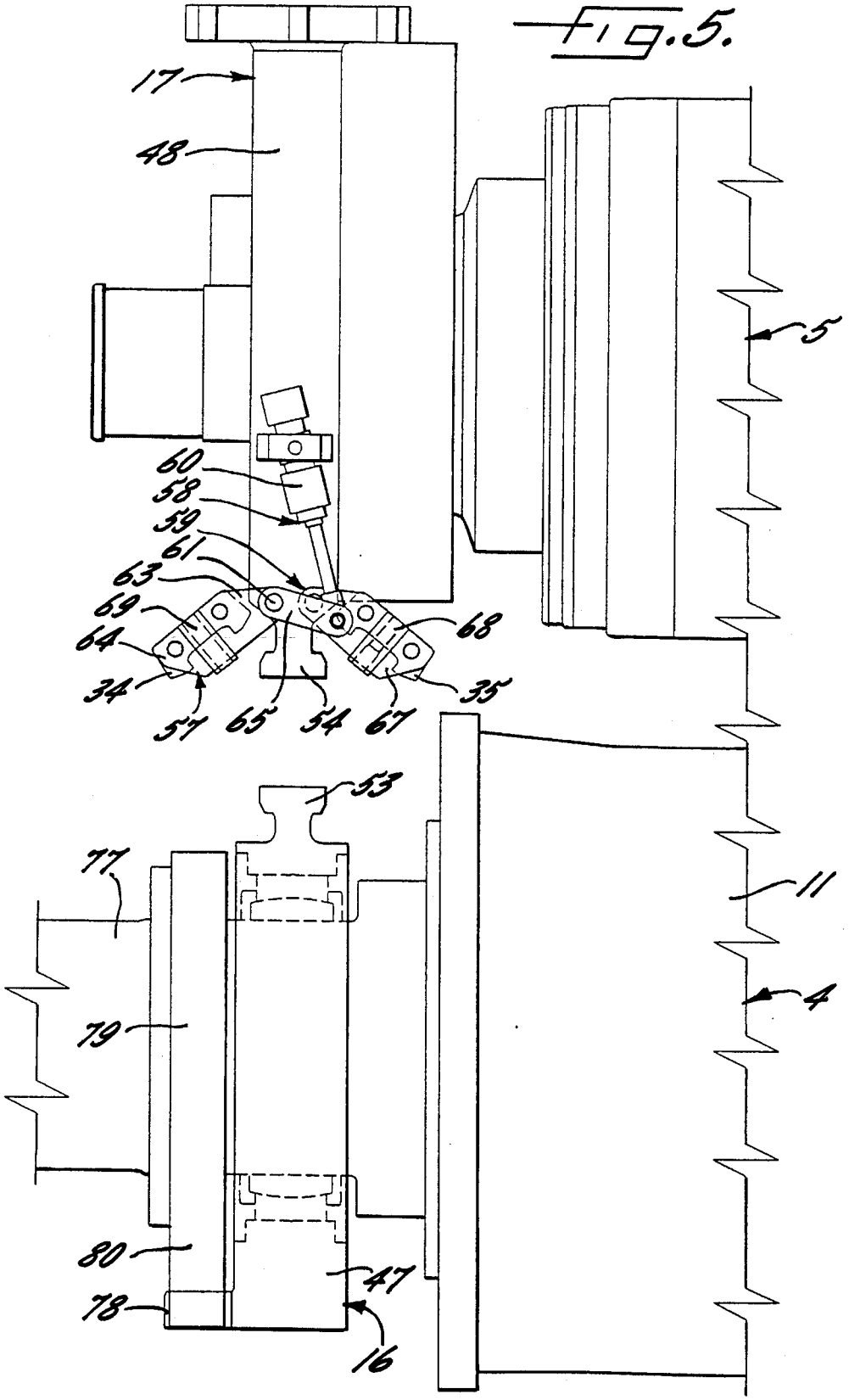
FIG. 5 is a longitudinal elevational view similar to FIG. 4 but showing the improved compact frame assembly when the two bearing housing members are disconnected from each other and one roll lifted up from the other.

In order to avoid that the weights of the channel bars 34 and 35 will be a bother to the mechanics, the device 57 for mounting the channel bars preferably includes a moving device 58 for moving the channel bars between a first position, shown in FIG. 4, where they are in engagement with head portion 53 of plate member 47 and foot portion 54 of plate member 48 in each pair of plate members, and a second position, shown in FIG. 5, where the channel bars are more spaced from each other and out of engagement with said portions, so as to permit foot portion 54 to be moved away from head portion 53. The moving device 58 may include a link system generally designated 59, in which the channel bars 34 and 35 are suspended, and at least one actuator 60 for swinging the links of the system and, thus, the channel bars 34 and 35 away from and back toward one another.

In the embodiment illustrated in FIGS. 3 to 5, there is a first set of links and an associated actuator located downstream of the press plane, thus on the right hand side in FIG. 3. There also is an identical second set of links and an associated actuator located upstream of the press plane. As is best shown in FIGS. 4 and 5, on its downstream side, plate member 48 of upper bearing housing member 17 of a pair has two horizontally projecting pivot pins 61 and 62 located side by side on a level with a root of the foot portion 54, which pivot pins extend parallel to each other and to the channel bars 34 and 35. A first link in the set of links is a two-armed lever 63 having a first arm 64 located in one vertical plane parallel to the press plane, a second arm 65 located in another vertical plane parallel to the press plane, and a bushing 66 fitting pivotally on pivot pin 61 and interconnecting the two arms 64 and 65. The first arm 64 is fixed to an end surface of channel bar 34, and the second arm 65 has a free end, to which actuator 60 is operatively connected. Actuator 60 is pivotally mounted on the downstream vertical narrow side of parallelepipedic plate member 48, so as to be able to move to the extent required when swinging two-armed lever 63 on pivot pin 61. In order to permit the second arm of two-armed lever 63 to move in a vertical plane axially outside pivot pin 62, pivot pin 61 and bushing 66 are considerably longer than pivot pin 62. A second link in the set of links is a one-armed lever 67, which is of a shape similar to that of said first arm 64 and fitted pivotally on the other pivot pin 62, and which is fixed to an adjacent end surface of the other channel bar 35.

If some flexibility in the linkage connecting the actuator to the channel bar is desired, bushing 66 in an embodiment not shown may consist of an inner and an outer metal tube and an intermediate tubular body of a resilient material, such as rubber, adhering to the exterior surface of the inner tube and to the interior surface of the outer tube. Then, one end of the outer tube is fixed to one of the arms of the two-armed lever, and the opposite end of the inner tube is fixed to the other arm of the two-armed lever.

A corresponding arrangement is provided at the opposite end of the channel bars 34 and 35, but there the two-armed lever has its first arm fixed to an end surface of channel bar 35, while the one-armed lever is fixed to an end surface of channel bar 34. Consequently, actuator 60 operates channel bar 34, while the actuator provided at the opposite end of the channel bars operates channel bar 35.

In order not to have to rely on the ability of the actuators 60 of maintaining the channel bars 34 and 35 in a position of maximum engagement with the head portion 53 and the foot portion 54 of the bearing housing members 16 and 17, respectively, when the press is in operation, it is suitable to provide for a locking of the relative positions. To achieve an inexpensive and reliable position locking of the channel bars 34 and 35, the device 57 for mounting the channel bars preferably includes at least one nut member 68 that is secured to an axial end of one 35 of the two channel bars 34 and 35, a screw guide member 69 secured to an adjacent axial end of the other channel bar 34, and a machine screw 70. More precisely, in the embodiment illustrated in FIG. 4 nut member 68 is secured to one-armed lever 67, and screw guide member 69 is secured to the first arm 64 of two-armed lever 63. Nut member 68 is tubular and, consequently, has a threaded bore, which extends in a direction substantially perpendicular to the web portion 36 of said one 35 of the channel bars. Also screw guide member 69 is tubular and has a bore extending in a direction substantially perpendicular to the web portion 36 of said other channel bar 34 and in alignment with the threaded bore when the two channel bars 34 and 35 are in engagement with the cross pieces 55 of the head portion 53 and the foot portion 54. The machine screw 70 extends through the bore of the screw guide member 69 and into threaded engagement with the threaded bore of the nut member 68. A tightening of machine screw 70 makes an end face of screw guide member 69 abut an adjacent end face of nut member 68, so as to fix the positions of channel bars 34 and 35 relative to each other. In the embodiment illustrated in FIGS. 3 to 5, a similar arrangement is provided also at the other end of each of the two channel bars 34 and 35, where the nut member is secured to the first arm of the two-armed lever fixed to channel bar 35, and the screw guide member is secured to the one-armed lever fixed to channel bar 34.

When, like in the illustrated embodiment, one of the two rolls 4 and 5 is a shoe type press roll 4 having a stationary support beam 10 and a rotatable, flexible roll shell 11 of a predetermined diameter, a maximum dimension of the bearing housing members 16 for the shoe type press roll 4 is smaller than said predetermined diameter, so as to permit a worn flexible shell 11 to be pulled out axially from the support beam 10 and exteriorly of the bearing housing member 16, and a new flexible shell to be substituted for the worn one by pulling the new shell exteriorly over the bearing housing member 16 and onto the support beam 10. This exchange is carried out by first disconnecting the interconnecting device from the bearing housing members 16 and 17, temporarily lifting roll 5 in relation to roll 4 and then temporarily lifting one end of the shoe type press roll 4 in relation to frame member 22. A temporary gap is formed between the bearing housing member 16 of the lifted end of the shoe type press roll 4 and frame member 22, thus allowing the exchange of shells to take place. As described above, in the illustrated embodiment, bearing housing member 16 basically has the shape of a circular disk of a diameter that is smaller than the diameter of the flexible roll shell 11.

FIGS. 8 to 11 illustrate a press section which is similar in construction to that previously described in detail with reference to FIGS. 1 to 7. To avoid repetitive description, elements of this press section which correspond to elements previously described with reference to FIGS. 1 to 7 will be identified with corresponding reference characters, and the elements which differ from those previously described will be identified with reference numbers in the hundreds series.

In summary, FIGS. 8 to 11 illustrate an alternative moving device 158 for moving the channel bars between a first position (shown in FIG. 8 and FIG. 9) where they are in engagement with head portion 53 of plate member 47 and foot portion 54 of plate member 48 in each pair of plate members, and a second position, (shown in FIG. 11) where the channel bars are more spaced from each other and out of engagement with said portions, so as to permit foot portion 54 to be moved away from head portion 53. The moving device 158 may include a link system generally designated 159, in which the channel bars 34 and 35 are suspended, and at least one actuator 160 for swinging the links of the system and, thus, the channel bars 34 and 35 away from and back toward one another.

Figure 9:
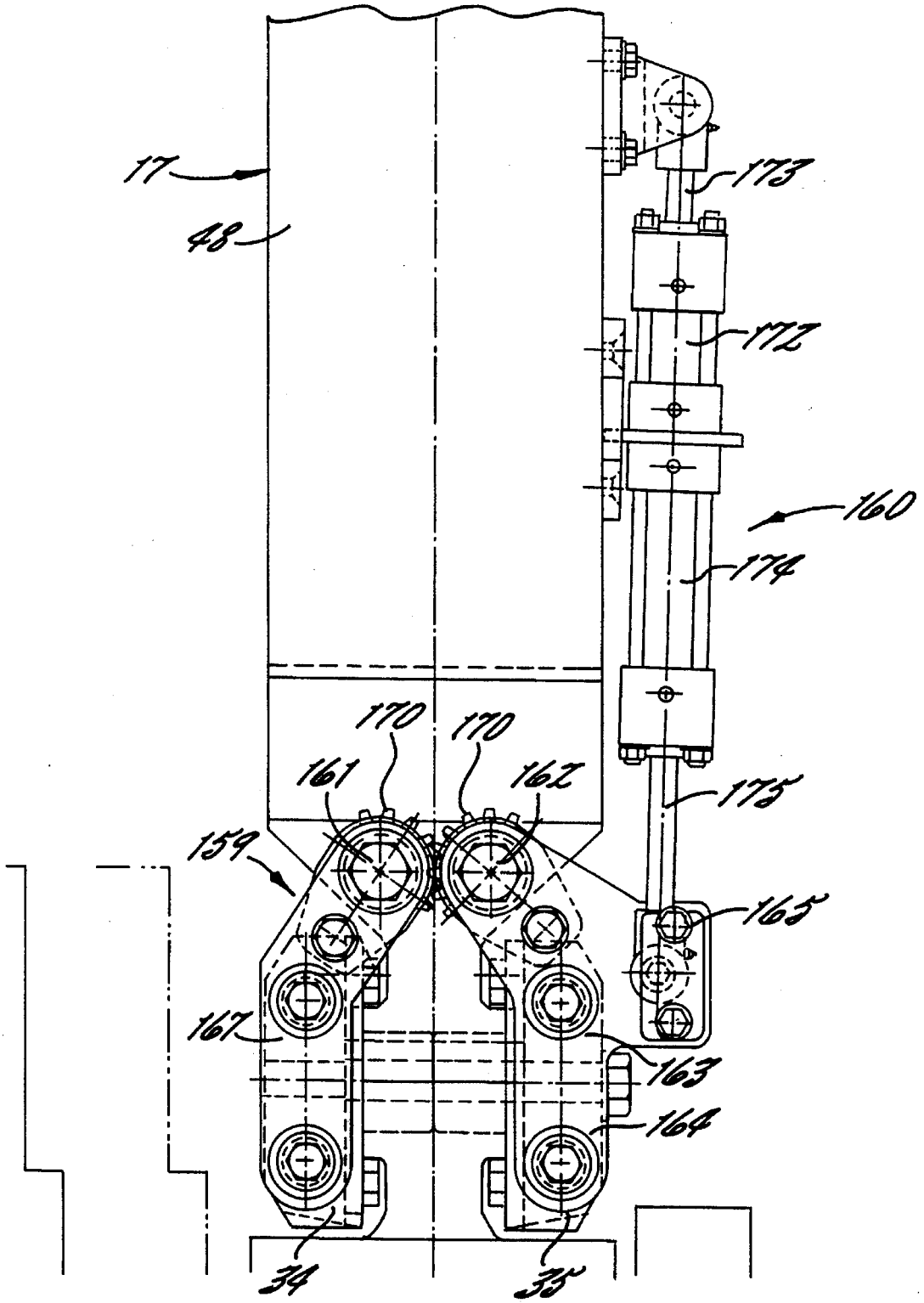
FIG. 9 is a longitudinal elevational view of the compact frame assembly shown in FIG. 8, in its position in engagement with the bearing housing members.
Figure 10:
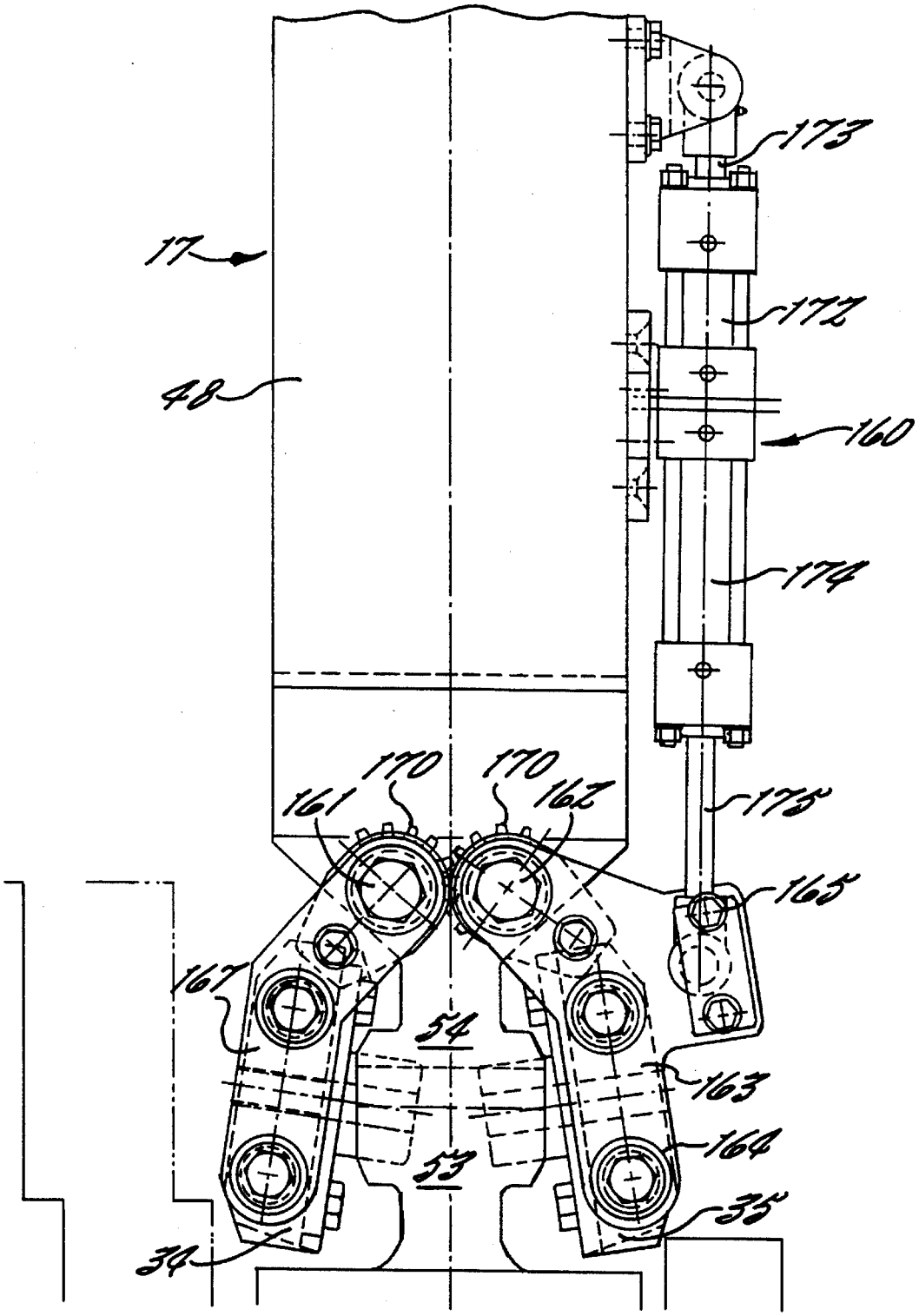
FIG. 10 is a longitudinal elevational view of the compact frame assembly of FIG. 9, moved to a position partially out of engagement with the bearing housing members.
Figure 11:
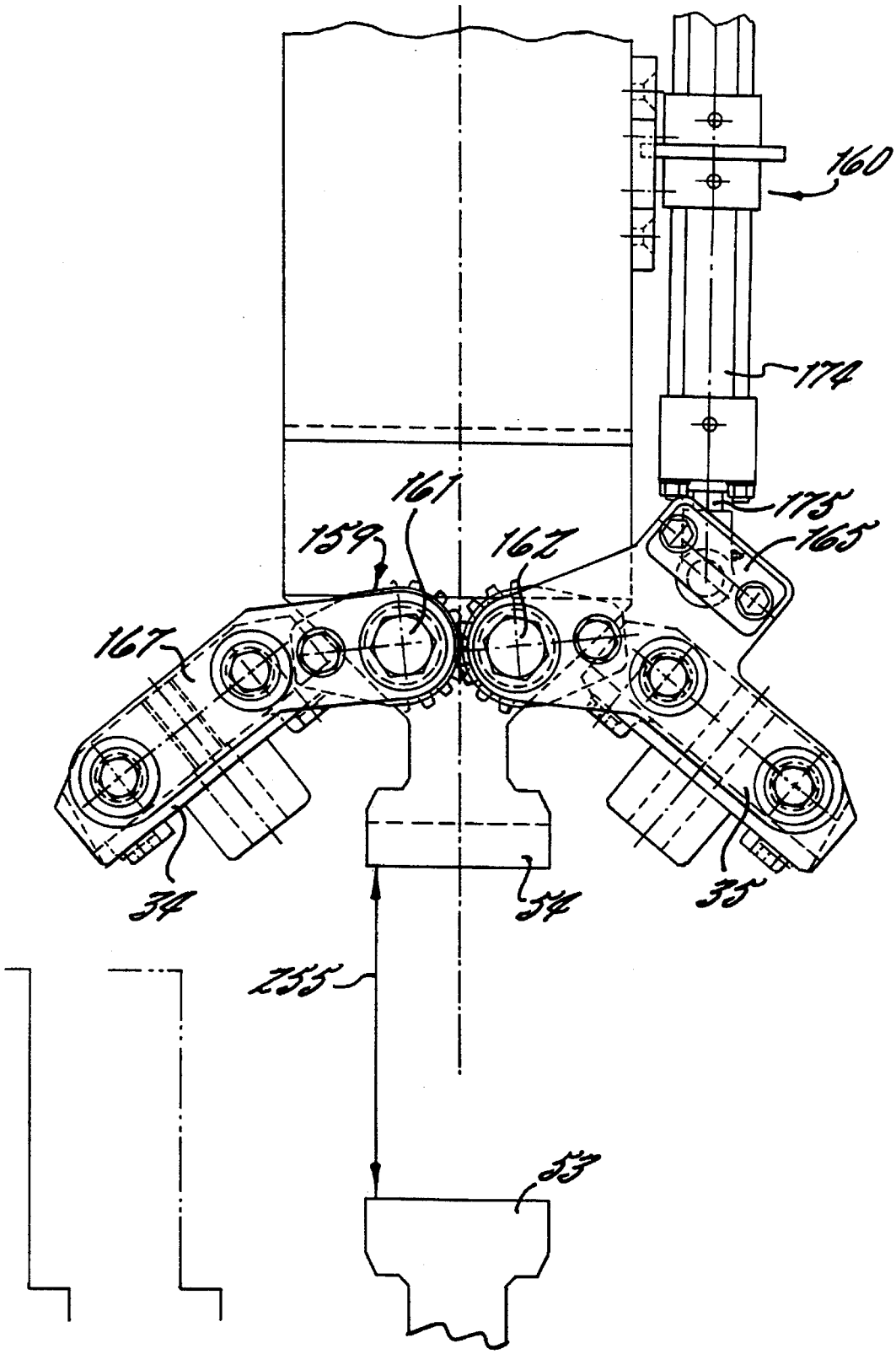
FIG. 11 is a longitudinal elevational view similar to FIG. 10, moved to a position fully out of engagement with the bearing housing members.

As best shown in FIGS. 9 to 11, on its downstream side, plate member 48 of upper bearing housing member 17 has a pair of horizontally projecting pivot pins 161 and 162 extending parallel to each other and to the channel bars 34 and 35. A first link in the linkage system 159 is a two-armed lever 163 which is pivotally mounted on pivot pin 162 and having a first arm 164 fixed to an end surface of channel bar 35 and a second arm 165 formed by a lug to which actuator 160 is operatively connected. A second link in the linkage system 159 is a one-armed lever 167, which is fitted pivotally on the other pivot pin 161, and which is fixed to an adjacent end surface of the other channel bar 34. A toothed member 170 having a gear sector is secured to each of the levers 163 and 167, with the teeth in meshing engagement. Thus, by operating the piston rods of actuator 160 to push or pull the lugs of the two-armed levers, the channel bars 34 and 35 are swung out of or into engagement with the foot portion 53 of the upper bearing housing member and the head portion 54 of the lower bearing housing member.

The actuators 160 are hydraulically operated piston and cylinder assemblies. Each such assembly has an upper comparatively short cylinder 172, an upper piston with an upwardly extending, comparatively short piston rod 173, a lower comparatively long cylinder 174, and a lower piston with a comparatively long piston rod 175 having a free end for engagement with the lug 165 of the two-armed lever. The upper section of the assembly which includes cylinder 172 and piston rod 173 has a comparatively short stroke and is used to swing the channel bars between the fully closed position shown in FIGS. 8 and 9 and the partly open position shown in FIG. 10. It will be seen in FIG. 10 that in the partly open position, the adjacent end of the lower roll 4 will prevent the innermost channel bar 34 from being swung out to its maximum open position. However, the channel bars are spaced apart sufficiently to permit the upper roll 5 to be lifted so that a gap of about ten inches is formed between the foot portion 54 and the head portion 53 as illustrated in FIG. 11. When the upper roll 5 has been lifted these ten inches, the longer stroke of the lower section of the actuator assembly which includes piston 174 and piston rod 175 can be used to swing out the channel bars to their most spaced apart position shown in FIG. 11. Then, a worn flexible roll shell can be easily be pulled out and a new one mounted in its place. If the upper roll can be lifted high enough above the lower roll to increase the gap from about ten to about fourteen inches, the channel bars do not need to be moved further outward than to the position shown in FIG. 10 in order not to obstruct a change of the flexible roll shell.

While the present invention above has been described with reference to the drawings, which show preferred embodiments, several obvious modifications thereof are possible within the scope of the appended claims. As an illustrative example, it would be possible to use another type of actuator and link mechanism for moving the channel bars into and out of engagement with the head portion of one bearing housing member and the foot portion of the adjacent bearing housing member. It would even be possible to refrain from using such a mechanism and instead install and remove the channel bars entirely manually. Similarly, it would be possible to provide in the web portion of one channel bar, a clearance bore acting as a screw guide member, and in the web portion of the other channel bar, an aligned threaded bore acting as a nut member, and to provide two opposed grooves of semicircular cross section in the opposing surfaces of the plate members of a plate member pair to permit the passage of the machine screw from the clearance bore to the threaded bore. It would also be possible to invert the positions of the two rolls of the press, so that the counter roll would be a bottom roll, and the shoe type press roll or other roll having a rotatable roll shell would be a top roll, and when the press is felted, it could also be double-felted instead of single-felted.

That which is claimed is:

1. A compact frame assembly for a press having two parallel opposed rolls for subjecting a moving web to pressure in a nip formed between the rolls, both of which have two ends, at least one of the rolls having a stationary support beam, a rotatable roll shell disposed about the beam and defining a space therebetween, and a roll shell support carried by the beam in the space for providing vertically-movable and rotatable support of the roll shell relative to the support beam, said compact frame assembly comprising a) four bearing housing members mountable one on each of the four roll ends for supporting the roll ends at least pivotally, each of the two bearing housing members for one of the rolls being disposed at an adjacent one of the two bearing housing members for the other roll and forming with said adjacent bearing housing member a pair of bearing housing members;

b) a device for interconnecting the two bearing housing members of each pair, said interconnecting device including for each pair of bearing housing members at least two interconnecting members, each of the at least two interconnecting members having a web portion and two rim portions projecting from the web portion, said two bearing housing members having surfaces defining recesses for engagement with said two respective rim portions so as to prevent the two bearing housing members of each pair from appreciably moving away from each other on loading of the press;

c) said at least two interconnecting members being in the shape of channel bars extending in a horizontal direction, said web portion and said two rim portions constituting a channel bottom and two channel sides, respectively, in each of the at least two channel bars, and each channel formed by each of the at least two channel bars having a symmetrical cross sectional shape that over a major portion of a channel depth is of a constant channel width from channel side to channel side;

d) each of the two bearing housing members in each pair including a plate member having two sides which, when the bearing housing member is mounted on a roll end, extend in a plane substantially parallel to a plane perpendicular to an axis of rotation of the rotatable roll shell, with one of the two sides facing the parallel opposed rolls and the other of the two sides facing in an opposite direction, said recesses being elongated and substantially L-shaped in cross section and located one in each of the two sides of the plate member at an edge thereof and extending parallel to each other and to said edge, so as to form in one of the two plate members a head portion of substantially T-shaped cross section and in the other of the two plate members a foot portion of inverted substantially T-shaped cross section, said head portion and said foot portion each comprising a cross piece with a central portion, two free ends, and a plane top face, the two plate members in each of the two pairs of bearing housing members being disposed with the cross piece top face of the head portion facing the cross piece top face of the foot portion, the cross piece of the head portion and the cross piece of the foot portion being of a combined thickness that is slightly smaller than the channel width of said respective channel bars; and e) a device for mounting said two channel bars with their channels facing each other, one on each side of the pair of plate members, and with the channel bars in clamping engagement with the cross piece of the head portion and the cross piece of the foot portion.

2. A compact frame assembly as claimed in claim 1, wherein the head portions of said plate members directly support the foot portions of the corresponding plate members when the press is unloaded.

3. A compact frame assembly as claimed in claim 1 or 2, further comprising means for preventing the two plate members of each plate member pair from being displaced relative to each other in a plane perpendicular to a loading direction of the press.

4. A compact frame assembly as claimed in claim 3, wherein said displacement preventing means is located between the two plate members of each pair of bearing housing members and includes keys disposed in two pairs of crossing opposed key-ways provided in the two plate members.

5. A compact frame assembly as claimed in claim 1, wherein said device for mounting said two channel bars includes a device for moving the channel bars between a first position, where the two channel bars are in engagement with the head portion and foot portion of each of the two plate members in a pair of bearing housing members, and a second position, where the two channel bars are more spaced from each other and out of engagement with said head and foot portions, so as to permit one of said head and foot portions of the two plate members to be moved away from the other of the two plate members.

6. A compact frame assembly as claimed in claim 1 or 5, wherein said device for mounting said two channel bars comprises:

a) at least one nut member secured to an axial end of one of the two channel bars, said at least one nut member having a threaded bore extending in a direction substantially perpendicular to the web portion of said one of the two channel bars;

b) a screw guide member secured to an adjacent axial end of the other of the two channel bars and having a bore extending in a direction substantially perpendicular to the web portion of said other of the two channel bars and in alignment with the threaded bore when the two channel bars are in engagement with the cross piece of the head portion and cross piece of the foot portion; and c) a machine screw extending through the bore of the screw guide member and into threaded engagement with the threaded bore of said at least one nut member.

7. A compact frame assembly as claimed in claim 1, for a press having an endless press fabric extending through the press nip, further comprising means for temporarily spacing one of the two opposed rolls from the other of the two opposed rolls, after first disconnecting the at least two channel bars from the two bearing housing members of said each pair, so as to form between the two opposed rolls a temporary gap in order to permit an exchange of the press fabric.

8. A compact frame assembly as claimed in claim 7, for a press wherein one of the two opposed rolls is a shoe press roll having a stationary support beam and a rotatable, flexible roll shell having a predetermined diameter, wherein a maximum dimension of the two bearing housing members for the shoe press roll is smaller than said predetermined diameter of said roll shell, so as to permit a worn flexible shell to be pulled out axially from the support beam and exteriorly of the two bearing housing members after disconnecting the at least two channel bars from the bearing housing members and temporarily spacing one of the two opposed rolls from the other of the two opposed rolls and then temporarily spacing one end of the shoe press roll from a frame member normally supporting the bearing housing member so as to form a temporary gap between the bearing housing member of said one end of the shoe press roll and said frame member, and a new flexible shell to be substituted for the worn one by pulling the new shell exteriorly over the bearing housing member and onto the support beam.

* * * * *